US006344722B1

(12) United States Patent
Abel

(10) Patent No.: US 6,344,722 B1
(45) Date of Patent: Feb. 5, 2002

(54) CONTROL DEVICE FOR A MEMBRANE PUMP

(75) Inventor: Goerdt Abel, Buchen (DE)

(73) Assignee: Abel GmbH & Co. KG, Bunchen (DE)

( * ) Notice: Subject to any disclaimer, the term of this patent is extended or adjusted under 35 U.S.C. 154(b) by 0 days.

(21) Appl. No.: 09/601,821

(22) PCT Filed: Oct. 5, 1999

(86) PCT No.: PCT/EP99/07399

§ 371 Date: Aug. 8, 2000

§ 102(e) Date: Aug. 8, 2000

(87) PCT Pub. No.: WO00/34659

PCT Pub. Date: Jun. 15, 2000

(51) Int. Cl.[7] ..... H02K 27/30; H02P 7/29; H02P 7/628; F04B 49/06

(52) U.S. Cl. ..... 318/434; 318/430; 318/436; 417/4; 417/3

(58) Field of Search ..... 318/430–460, 318/560–696, 286, 282, 283; 388/829, 831; 417/43, 42, 22, 45

(56) References Cited

U.S. PATENT DOCUMENTS

| | | | | |
|---|---|---|---|---|
| 4,063,140 A | * | 12/1977 | Kammerer et al. | 318/561 |
| 4,445,075 A | * | 4/1984 | Fry | 318/434 |
| 4,971,522 A | | 11/1990 | Butlin | 417/18 |
| 5,059,879 A | * | 10/1991 | Watanabe | 318/603 |
| 5,155,422 A | * | 10/1992 | Sidman et al. | 318/560 |
| 5,668,457 A | | 9/1997 | Motamed | 318/606 |
| 6,154,605 A | * | 11/2000 | Aonuma | 388/829 |

FOREIGN PATENT DOCUMENTS

| | | |
|---|---|---|
| DE | 40 32 876 A1 | 4/1992 |
| DE | 43 35 403 C1 | 12/1994 |
| EP | 0 833 436 | 4/1998 |
| WO | 95/-9305 | 4/1995 |

OTHER PUBLICATIONS

Fink, Werner: Stufenlose Drehzahlverstellung von Pumpen erlaubt weitere Regelmethoden. In: Maschinenemarkt, Wurzburg, 88 Jg., 1982, 28 pp 423–525.

JP 2–49983A In: Patent Abstract of Japan, M–970, Max 8, 1990, vol. 14, No. 217.

Nafpaktitis D et al: Ein Vorschlag Zur Verbesserung Des Anlaufverhaltens Von Stromrichtermotoren Elektrotechnik Und Informationstechnik at Springer Verlag, Wie Bd, 108, No. 10, pp. 435–438.

* cited by examiner

*Primary Examiner*—Paul Ip
(74) *Attorney, Agent, or Firm*—Vidas, Arrett & Steinkraus P.A.

(57) ABSTRACT

A control device for a diaphragm pump to feed a filter press or similar user unit comprising a three-phase electric driving motor for the pump which is connected to a supply main via a variable-frequency converter, which frequency converter has an analogue output at which a signal will appear which corresponds to the respective motor torque, a standard r.p.m. set-point adjuster to the input of which the actual signal is provided via an inverter and in which a graph is stored which produces an interdependences between the motor torque and the speed such that if the actual-signal rates are small the graph for the speed runs along a constant maximum value and if a preset rate is reached for the actual signal it gradually declines to a minimum value, and an attenuation member for the actual signal.

5 Claims, 2 Drawing Sheets

CONTROL DEVICE FOR A MEMBRANE PUMP

BACKGROUND OF THE INVENTION

This invention relates to a control device for a diaphragm pump according to the preamble of claim 1.

Diaphragm pumps are employed for many uses. They are operated either mechanically or hydraulically. They serve, for instance, for charging filter presses or similar user units such as spray tower feeders and the like.

Whenever a filter press is charged its receiving capacity decreases, during a filtering cycle, to the extent to which filter cake builds up. Pressure will rise in a similar way. Therefore, care has to be taken of this behaviour while the pump is being run. It is known to diminish the reciprocating motion of the diaphragm when pressure rises in order to provide for a decrease in the delivery rate approximately towards zero when a preliminarily fixed filtering pressure has been reached.

It is further known to operate the driving motor, e.g. a three-phase motor, via a frequency converter and to match the delivery rate and the pumping pressure in dependence upon the pressure measured. To this effect, the line between the pump and the filter press is associated with a pressure transducer the output signal of which is provided to a stored-program control. This one produces the corresponding actuating signal for the frequency converter according to a preset program to adapt the speed of the driving motor to the pressure conditions through a change to the output frequency of the converter. Stored-program controls as are required for such speed regulations are relatively expensive.

From DE 43 35 403, it is also known to control a plastic material injection moulding machine by means of a three-phase synchronous motor and a frequency converter. It is even this arrangement which measures the pressure supplied to the injection means and uses it to adjust the hydraulic pump.

SUMMARY OF THE INVENTION

It is the object of the invention to provide a control device for a diaphragm pump which works with a minimum of apparatus required.

This object is achieved by the features of claim 1.

An electric driving motor, especially a three-phase asynchronous motor, drives the diaphragm pump. The driving motor is fed from a variable-frequency converter, which converter, in turn, is connected to the mains, e.g. a 50 Hz or 60 Hz mains. The variable-frequency converter has an analogue output at which a signal appears, e.g. a current which is indicative of the respective motor torque.

The invention further provides a standard r.p.m. set-point adjuster which does not preset a constant speed rate, but presets a set-point graph which is stored in the standard r.p.m. set-point adjuster. The graph firstly comprises a constant branch which corresponds to a maxium speed. Since the output of the frequency converter is provided to the input of the standard r.p.m. set-point adjuster via an inverter a small signal (the motor torque) at the output results in a large signal (the motor speed) at the input of the standard r.p.m. set-point adjuster. In other words, if torques are relatively small the standard r.p.m. set-point adjuster presets a maximum speed rate. This one may definitely be higher, for example, than such a rate as is reached at 50 or 60 Hertz. Even a speed rate which corresponds, for example, to a frequency of 130 Hz may be preset. Such a speed set-point is operated at until the torque arrives at a critical value. This corresponds to an operating phase in which the user unit pressure has reached the regulated pressure of the process. From this point onwards, the speed set-point will be operated at along a preset, declining graph, preferably along a straight line. The behaviour of the declining graph or straight line is such that a desired user unit pressure or pressure behaviour is obtained. This one is known to depend upon the respective operating condition of the user unit, e.g. a filter press.

The declining graph is followed up to a minimum speed which is then kept constant, e.g. to a rate at which the electric motor is just continuing to rotate. For example, this corresponds to a speed of 2.0 r.p.m.

The inventive device also includes an attenuation member. It provides for the periodical fluctuations of the actual signal as inevitably will occur in a diaphragm pump to be dampened to such an extent that a processable signal is obtained.

The inventive device has the advantage that it may use a conventional frequency converter which may be completed by appropriate switching elements only to a minimum degree. External control and regulating means are not required. Specifically, any pressure transducer for regulating purposes may completely be dispensed with. As has been found in practice the invention readily makes it possible to proportionally react to the sludge pressure building up in the filter press via the motor torque.

BRIEF DESCRIPTION OF DRAWINGS

The invention will now be explained with reference to drawings.

DESCRIPTION OF THE INVENTION

Figure 1:
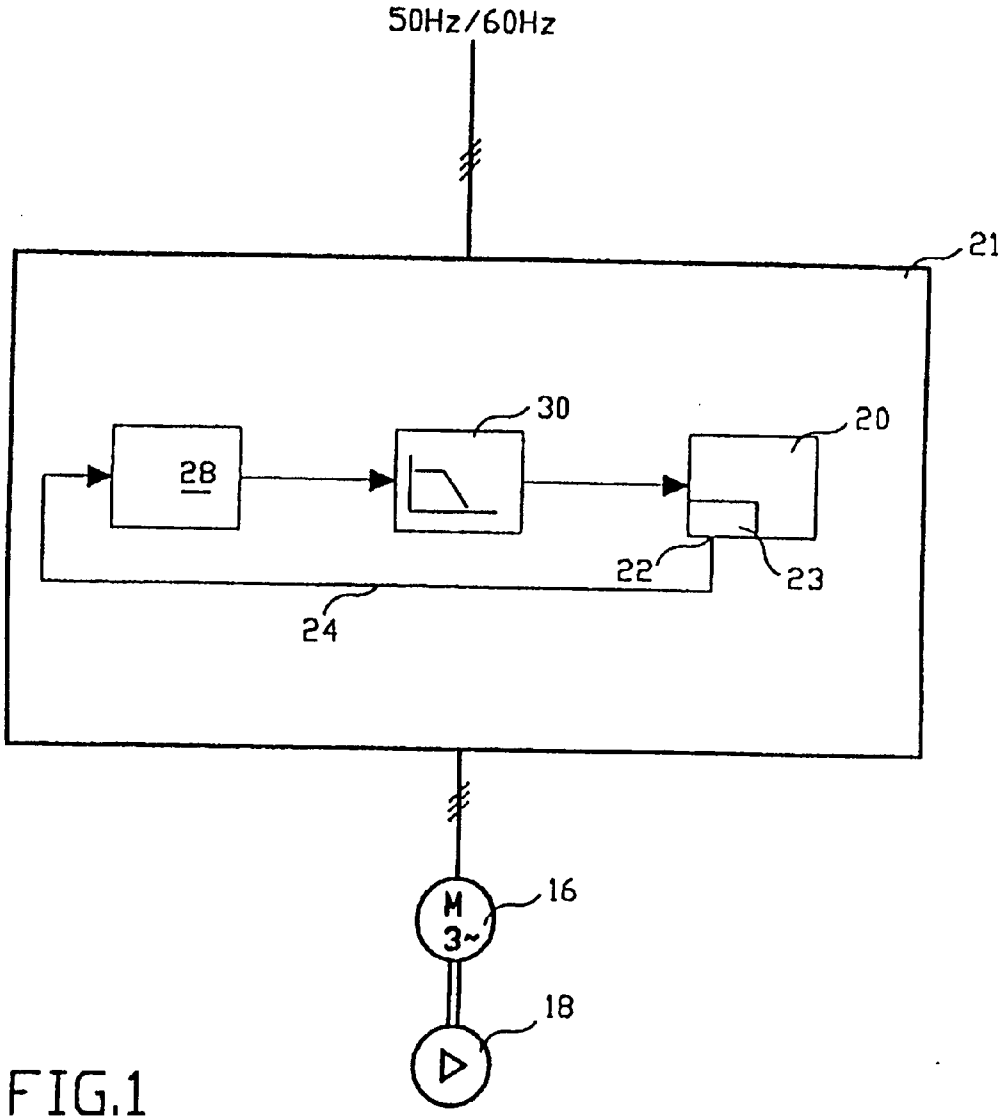
FIG. 1 schematically shows a block diagram according to the invention.

Referring to FIG. 1, a diaphragm pump 18 is shown which is driven by a three-phase motor 16. Three-phase motor 16 is connected to the mains via a frequency converter 21. The frequency of the motor may be varied between 2 Hz and 130 Hz. The motor currents detected in a d.c.-to-a.c. inverter 20 are determined and will appear as actual signals for the torque of motor 16 at an analogue output 22. The signal is a current signal which fluctuates between 0 and 21 mA. Current 0 denotes an infinitely small torque and a maximum current signifies a maximum torque.

Since the pump produces a rising pressure the signal at the output 22 rises correspondingly. An attenuation member 23 provides for the actual signal to be equalized accordingly. The actual signal is preferably dampened by means of a filtering time constant such as 8 seconds. At the same time, this constant can be used to adapt it to the respective pump size.

The actual signal is provided from output 22 through a line 24 to the input of an inverter 28 which, in turn, is connected to a standard r.p.m. set-point adjuster 30.

Figure 2:
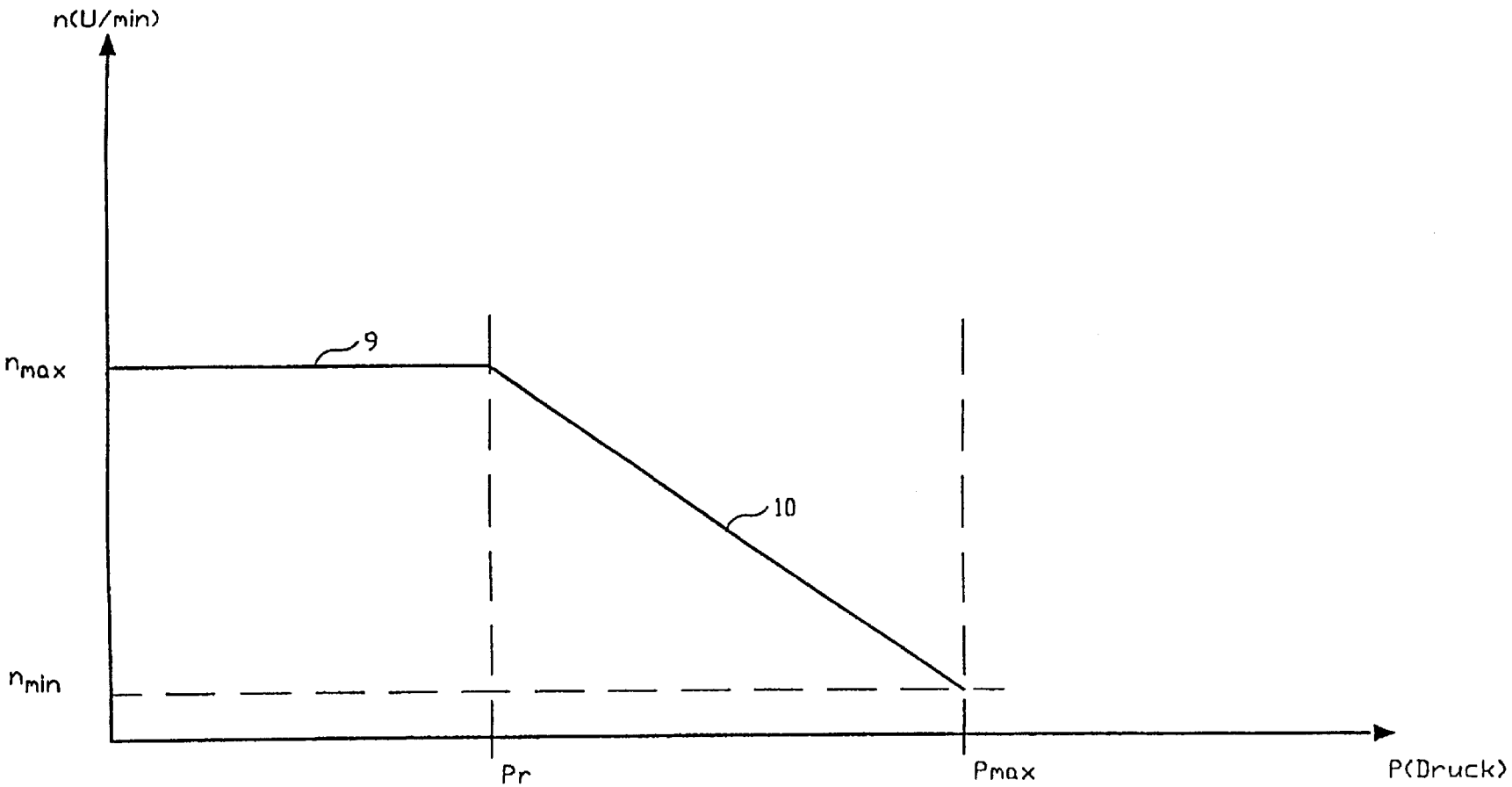
FIG. 2 shows a diagram depicting the pressure and speed behaviour when a filter press is charged using the device of FIG. 1.

Thus, if the torque is small a high signal will appear at the input of standard r.p.m. set-point adjuster 30. In case of such signal, a maximum rate is preset for the speed in standard r.p.m. set-point adjuster 30, which rate is kept constant through a preset range along a horizontal branch indicated by 9 in FIG. 2. If pressure rises in the user unit, which makes itself felt by an increase in the actual signal, the output signal of the standard r.p.m. set-point adjuster 30 will gradually be reduced along a second branch 10 of the graph, which namely is a declining straight line, i.e. to a preset minimum speed rate which may be 2.0 r.p.m. The minimum speed corresponds to the minimum flow rate in the pump and, thus, approximately keeps constant the maximum pressure $P_{max}$ which has been reached up to the press switch-off pressure.

In addition, it should be noted that frequency converter 21, as is known per sé, has integrated in it a speed governor which governs the speed at a level determined by the speed set-point in order that the pump be driven at the speed required. Such a governor, for example, is a PID governor.

What is claimed is:

1. A control device for a diaphragm pump to feed a filter press, comprising a three-phase electric driving motor (16) for the pump (18) which is connected to a supply mains via a variable-frequency converter (21), which frequency converter has an analogue output (22) at which a signal will appear which corresponds to the respective motor torque, a standard r.p.m. set-point adjuster (30) to the input of which the actual signal is provided via an inverter (28) and in which a graph is stored which produces an interdependence between the motor torque and the speed such that if the actual-signal rates are small the graph for the speed runs along a constant maximum value and if a preset rate is reached for the actual signal it gradually declines to a minimum value, and an attenuation member (23) for the actual signal.

2. The device according to claim 1, characterized in that the declining graph is a straight line.

3. The device according to claim 1, characterized in that a lower speed rate ($n_{min}$) is stored in the standard r.p.m. set-point adjuster (30) and the output signal is kept constant when the lower speed rate ($n_{min}$) has been reached.

4. The device according claim 1, characterized in that the upper speed rate ($n_{max}$) corresponds to a frequency of the frequency converter (21) which is above the mains frequency.

5. The device according to any of claims 1, characterized in that the graph (10) may be programmed and may be adapted to the respective user unit for the pump.

* * * * *